US010129636B2

(12) United States Patent
Kim et al.

(10) Patent No.: US 10,129,636 B2
(45) Date of Patent: Nov. 13, 2018

(54) SPEAKER DEVICE FOR IMPROVING SOUND QUALITY IN HIGH FREQUENCY BAND

(71) Applicant: Samsung Electronics Co., Ltd., Gyeonggi-do (KR)

(72) Inventors: Taeeon Kim, Seoul (KR); Youngbae Park, Seoul (KR); Byoung-Hee Lee, Seoul (KR); Taiyong Kim, Gyeonggi-do (KR); Ki-Won Kim, Gyeonggi-do (KR); Juhee Chang, Gyeonggi-do (KR); Ho-Chul Hwang, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 15/602,518

(22) Filed: May 23, 2017

(65) Prior Publication Data

US 2018/0007463 A1 Jan. 4, 2018

(30) Foreign Application Priority Data

Jul. 4, 2016 (KR) ..... 10-2016-0084106

(51) Int. Cl.
*H04R 1/28* (2006.01)
*H04R 1/34* (2006.01)

(52) U.S. Cl.
CPC ..... *H04R 1/2803* (2013.01); *H04R 1/345* (2013.01); *H04R 2499/11* (2013.01)

(58) Field of Classification Search
CPC ... H04R 1/2803; H04R 1/345; H04R 2499/11
See application file for complete search history.

(56) References Cited

U.S. PATENT DOCUMENTS

| | | | | |
|---|---|---|---|---|
| 4,907,671 | A | 3/1990 | Wiley | |
| 5,446,792 | A | 8/1995 | Sango | |
| 6,031,920 | A | 2/2000 | Wiener | |
| 6,134,332 | A | 10/2000 | Wiener | |
| 6,257,365 | B1 | 7/2001 | Hulsebus, II | |
| 8,098,852 | B2 | 1/2012 | Harwood et al. | |
| 8,442,242 | B2 | 5/2013 | Harwood | |
| 8,477,967 | B2 | 7/2013 | Harwood et al. | |
| 2016/0050497 | A1* | 2/2016 | Daubigny | H04R 9/06 381/120 |
| 2016/0227315 | A1* | 8/2016 | Kim | H04R 1/2819 |
| 2017/0195783 | A1* | 7/2017 | Gladwin | G10K 11/30 |

* cited by examiner

*Primary Examiner* — Mark Fischer
(74) *Attorney, Agent, or Firm* — Cha & Reiter, LLC.

(57) ABSTRACT

An electronic device having a speaker device. The electronic device may include a housing, a speaker device disposed inside the housing, and a sound generation circuit electrically connected to the speaker device. The speaker device may include a sound generation plate movable in a first direction, and a sound reflection construction facing the sound generation plate to form a space between the sound generation plate and the sound reflection construction. The sound generation plate includes a first surface disposed substantially at a center of the sound generation plate, the first surface having a convex shape when viewed from inside the space, and the sound reflection construction includes a second surface substantially aligned with the first surface along an axis of the housing, the second surface having a concave shape when viewed from inside the space.

17 Claims, 8 Drawing Sheets

SPEAKER DEVICE FOR IMPROVING SOUND QUALITY IN HIGH FREQUENCY BAND

CLAIM OF PRIORITY

This application claims the benefit under 35 U.S.C. § 119(a) of a Korean patent application filed in the Korean Intellectual Property Office on Jul. 4, 2016 and assigned Serial No. 10-2016-0084106, the entire disclosure of which is hereby incorporated by reference.

BACKGROUND

1. Field of the Present Disclosure

Various exemplary embodiments of the present disclosure relate to a speaker device.

2. Description of the Related Art

A speaker device may be used for various types of wired or wireless communication (e.g., a speaker may be used to output a phone call, where the speaker and the phone are wirelessly connected via Bluetooth modules). The speaker device may reflect sound by using an acoustic lens, which radiates sound in all directions. Thus, the acoustic lens may play be a reflector of the sound.

SUMMARY

However, since the acoustic lens of the speaker device is designed to uniformly reflect the sound in all bands, the band for sound reproduction may be narrow. In particular, sound pressure loss may occur in a specific band.

According to various exemplary embodiments of the present disclosure, there may be provided a speaker device which improves sound quality at a high frequency band.

According to one exemplary embodiment of the present disclosure, a speaker device may include a housing, a speaker unit disposed substantially at a center of the housing and adapted to emit sound in a first direction, the speaker unit including a vibration portion includes a cap having a convex shape in the first direction and a cone portion extending outwardly from the cap, and an acoustic lens disposed in the housing having a surface facing the vibration portion, the acoustic lens is adapted to reflect the emitted sound in a second direction. A gap distance between the vibration portion of the speaker unit and the surface of the acoustic lens is substantially constant.

According to one exemplary embodiment of the present disclosure, a portable speaker device may include a speaker unit having a vibration portion, and an acoustic lens having a surface disposed to face the vibration portion and adapted to reflect an emitted sound from the speaker unit. A gap distance between the vibration portion and the surface of the acoustic lens is a distance at which the vibration portion provides a maximum amplitude of the emitted sound to the acoustic lens, and the gap distance is substantially constant.

According to one exemplary embodiment of the present disclosure, an electronic device may include a housing, a speaker device disposed inside the housing, and a sound generation circuit electrically connected to the speaker device. The speaker device may include a sound generation plate movable in a first direction when sound is generated by the sound generation circuit, and a sound reflection construction facing the sound generation plate to form a space between the sound generation plate and the sound reflection construction. The space is in fluidic communication with an exterior of the housing via a plurality of sound holes formed in a outer wall of the housing, the sound generation plate includes a first surface disposed substantially at a center of the sound generation plate, the first surface having a convex shape when viewed from inside the space, and the sound reflection construction includes a second surface substantially aligned with the first surface along an axis of the housing, the second surface having a concave shape when viewed from inside the space.

According to one or more exemplary embodiments of the present disclosure, sound performance of a high frequency band can be improved in a speaker device.

DETAILED DESCRIPTION

Figure 1:
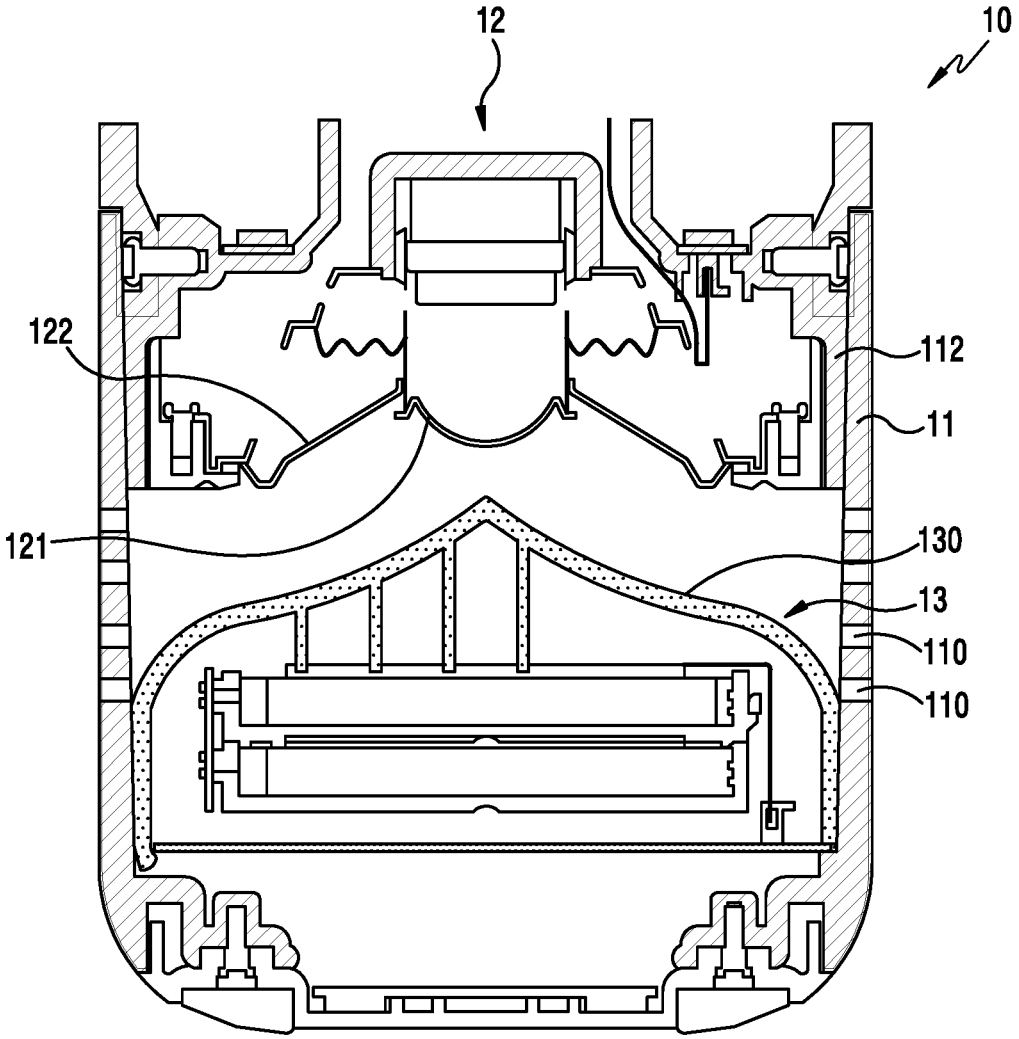
FIG.1 (PRIOR ART)
FIG. 1 is a cross-sectional view illustrating a structure of a speaker device according to the prior art.

Hereinafter, various embodiments of the present disclosure will be described with reference to the accompanying drawings. However, it should be understood that there is no intent to limit the present disclosure to the particular forms disclosed herein; rather, the present disclosure should be construed to cover various modifications, equivalents, and/or alternatives of embodiments of the present disclosure. In describing the drawings, similar reference numerals may be used to designate similar constituent elements.

As used herein, the expression "have," "may have," "include," or "may include" refers to the existence of a corresponding feature (e.g., numeral, function, operation, or constituent element such as component), and does not exclude one or more additional features.

In the present disclosure, the expression "A or B," "at least one of A or/and B," or "one or more of A or/and B" may include all possible combinations of the items listed. For example, the expression "A or B," "at least one of A and B," or "at least one of A or B" refers to all of (1) including at least one A, (2) including at least one B, or (3) including all of at least one A and at least one B.

The expressions such as "first," "second," or the like used in descriptions of the various embodiments of the present disclosure may modify various elements regardless of order or importance, and do not limit corresponding elements. The above-described expressions may be used to distinguish an element from another element. For example, a first user device and a second user device indicate different user devices although both of them are user devices. For example, a first element may be termed a second element, and similarly, a second element may be termed a first element without departing from the scope of the present disclosure.

It should be understood that when an element (e.g., first element) is referred to as being (operatively or communicatively) "connected," or "coupled," to another element (e.g., second element), it may be directly connected or coupled directly to the other element or any other element (e.g., third element) may be interposer between them. In contrast, it may be understood that when an element (e.g., first element) is referred to as being "directly connected," or "directly coupled" to another element (second element), there are no element (e.g., third element) interposed between them.

The expression "configured to" used in the present disclosure may be exchanged with, for example, "suitable for," "having the capacity to," "designed to," "adapted to," "made to," or "capable of" according to the situation. The expression "configured to" may not necessarily mean "specially designed to" in terms of hardware. Alternatively, in some situations, the expression "device configured to" may mean that the device, together with other devices or components, "is able to." For example, the phrase "processor adapted (or configured) to perform A, B, and C" may mean a dedicated processor (e.g., embedded processor) only for performing the corresponding operations or a generic-purpose processor (e.g., central processing unit (CPU) or application processor (AP)) that can perform the corresponding operations by executing one or more software programs stored in a memory device.

The terms used herein are merely for the purpose of describing particular embodiments and are not intended to limit the scope of other embodiments. As used herein, singular forms may include plural forms as well unless the context clearly indicates otherwise. Unless defined otherwise, all terms used herein, including technical terms and scientific terms, may have the same meaning as commonly understood by a person of ordinary skill in the art to which the present disclosure pertains. Terms, such as those defined in commonly used dictionaries, should be interpreted as having a meaning that is the same or similar to their meaning in the context of the relevant art and will not be interpreted in an idealized or overly formal sense unless expressly so defined herein. In some cases, even the term defined in the present disclosure should not be interpreted to exclude embodiments of the present disclosure.

Hereinafter, various embodiments of the present disclosure will be described with reference to the accompanying drawings.

FIG. 1 is a cross-sectional view illustrating a structure of a speaker device 10 according to the prior art.

Referring to FIG. 1, the speaker device 10 according to the prior art includes a housing 11, a speaker unit 12, and an acoustic lens 13. The speaker unit 12 may be fixed to the housing 11 by an inner support construction 112, and the acoustic lens 13 may be disposed to face the speaker unit 12 for sound reflection at various frequencies. The speaker unit 12 is disposed to face the acoustic lens 13, and thus a sound radiated from the speaker unit is reflected by a surface 130 of the acoustic lens and is directed in other directions.

A cap 121 of the speaker unit 12 according to the prior art may be disposed to be convex towards the acoustic lens 13. Meanwhile, the acoustic lens 13 may be configured to be symmetrical with respect to the center longitudinal axis of the speaker device 10 and be in a substantially cone shape which has a sharpest point at its center and be smoother at its periphery. According to a disposition of the cap 121 and the acoustic lens 13, sound reflected from the speaker unit 12 may is radiated in all directions from the acoustic lens 13. A reference numeral 110 may refer to a plurality of sound holes through which sound reflected by the surface of the acoustic lens is emitted to the exterior of the speaker device 10.

However, in the device shown in FIG. 1, when the vibration portion of the speaker unit and the acoustic lens are located in the speaker device to face each other, and the acoustic lens is designed and disposed such that sound performance is uniform in all frequency bands. In such systems, sound performance (quality) may deteriorate at a specific band, for example, at a high frequency band.

Further, the speaker device may have a problem when the space between the vibration portion of the speaker unit and the acoustic lens is wide. In such cases, the acoustic lens has a narrow reproduction band, which may result in sound pressure loss at the high frequency band.

To remedy these problems, the acoustic lens may be designed to be asymmetrical about the longitudinal axis of the speaker device. However, when the acoustic lens is asymmetrical, although sound quality is improved at the specific high-frequency band, the sound quality may deteriorate at other bands.

Figure 2:
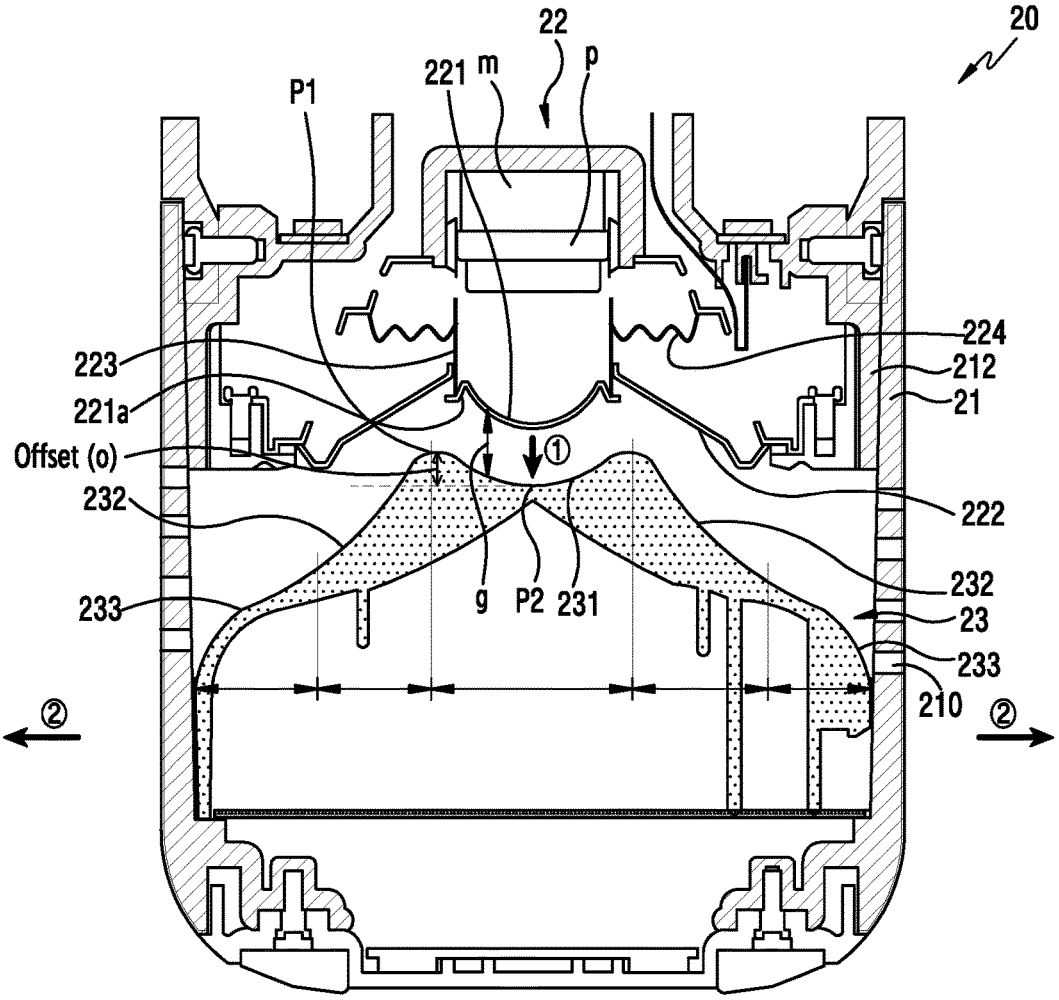
FIG. 2 is a cross-sectional view illustrating a structure of a speaker device according to one exemplary embodiment of the present disclosure.

FIG. 2 is a cross-sectional view illustrating a structure of a speaker device 20 according to one exemplary embodiment of the present disclosure.

Referring to FIG. 2, the speaker device 20 according to one exemplary embodiment may be a wireless speaker device or a wired speaker device. The speaker device according to the one exemplary embodiment may be a speaker device mounted on various electronic devices or a speaker device placed in a house or a vehicle. In case of the wireless speaker device, a wireless communication device such as a Bluetooth module or a Wi-Fi module or the like may be used. The speaker device 20 according to the one exemplary embodiment may include a housing 21, a speaker unit 22, and an acoustic lens 23.

The housing 21 according to one exemplary embodiment may be configured in various shapes as a protective member for housing various electronic components, the speaker unit 22, the acoustic lens 23, and/or the like. For example, the housing 21 may be in a cylindrical shape, a polygonal shape, a spherical shape, or the like. The housing 21 may include an inner support construction 212 for fixing the speaker unit 22 in place. The housing 21 may have one or more sound holes 210 formed on at least one portion of an outer surface thereof to output sound emitted from the speaker unit 22. For example, the plurality of sound holes 210 may be formed on an outer circumferential surface of the housing 21 at regular equidistance intervals.

The speaker unit 22 according to one exemplary embodiment may be fixed to the housing 21 by the inner support construction 212. The speaker unit 22 may be placed such that sound is emitted in a first direction (an arrow ①) in the housing 21. The speaker unit 22 may include a magnet m, a plate p, a bobbin 223, a damper 224, at least one sound generation plate or vibration portion, or the like. The magnet m, the plate p, the bobbin 223, the damper 224, or the like may constitute a sound generator for emitting sound. Although not shown, the sound generator may include a sound generation circuit electrically connected thereto. The sound may be generated by an operation of the sound generation circuit.

The vibration portion according to one exemplary embodiment vibrates depending on the sound generated, and may include a cap 221 and a cone portion 222. The cap is a center portion of the sound generation plate, and may be a portion which is convex in the first direction, that is, towards a sound reflection construction or an acoustic lens.

The cap 221 according to one exemplary embodiment is disposed to a center of the vibration portion, and thus may be called the center cap 221 or may be alternatively called a dust cap. The cone portion 222 may be a portion extending outwardly from the cap 221 to vibrate in the vicinity of the cap 221. The cone portion 222 may be substantially in the shape of a cone. The cap 221 may be a portion which vibrates when being supported by the bobbin 223 at an edge 221*a*. The cap 221 may include a convex or slightly protruding shape in a reverse direction of the first direction (arrow ①) at the edge 221*a*. Alternatively, the cap 221 may be constructed to not have a curvature.

The cap 221 according to one exemplary embodiment may be configured in various cross-sectional shapes. For example, the cap 221 may have a convex shape in a first direction (arrow ①) or a convex shape (see FIG. 7) in a reverse direction of the first direction (arrow ①) or may be configured substantially in a gentler curved shape (see FIG. 8), an almost flat shape, or the like.

The cone portion 222 according to one exemplary embodiment may have its center coincide with the cap 221, and may be formed to cover the cap 221. The cone portion 222 may be disposed to be convex in the reverse direction of the first direction (arrow ①). The cone portion 222 and the cap 221 are both vibrating portions, and may emit sound to surfaces 231, 232, and 233 of the acoustic lens facing the cap 221 and the cone portion 222. An inner edge of the cone portion 222 may vibrate when being supported by the bobbin 223. An outer edge of the cone portion 222 may vibrate when being supported by the inner support construction 212. As it is readily apparent in FIG. 2, the cone portion 222 is substantially in a cone shape in that the cone portion 222 slopes downwards as it extends outwardly from its center.

The acoustic lens 23 according to one exemplary embodiment may be a component for reflecting sound delivered from the vibration portion in a second direction (arrow ②) different from the first direction (arrow ①) For example, the acoustic lens 23 may be called a sound reflection device, a sound reflection construction, or a sound reflection plate. In another example, the first direction may substantially coincide with the longitudinal direction of the speaker device 20 and the second direction may be substantially perpendicular to the first direction.

The acoustic lens 23 according to one exemplary embodiment is disposed to face the vibration portion such that a specific gap is maintained. For example, at the center, the interval between the surface of the vibration portion and the surface of the acoustic lens may be in the range of 0.05 mm and 3.0 mm. In particular, the acoustic lens 23 may be disposed such that a surface facing the vibration portion (called an acoustic lens surface) and the vibration portions 221 and 222 maintain a specific gap. The gap means there is a space between the vibration portions 221 and 222 and the acoustic lens, where the gap distance is denoted in FIG. 2 as 'g.' In addition, the space in this gap may be in fluidic communication with the exterior of the housing via the plurality of sound holes 210. When the vibration portion (or the sound generation plate) is viewed from inside the space of the gap, the surface of the cap 221 is seen as having a convex surface. Furthermore, the surface of the cap 221 may be in the shape of a substantially circular arc with a first diameter. When the acoustic lens 23 (the sound reflection plate) is viewed from inside the space of the gap, the first surface 231 of the acoustic lens may be seen as being concave. The first surface 231 may be in the shape a substantially circular arc with a second diameter. The first diameter may be smaller than the second diameter.

A reflection surface of the acoustic lens 23 facing the vibration portions 221 and 222 may be substantially divided into three regions. For example, the surface of the acoustic lens 23 may include the first surface 231 which maintains the specific gap with respect to the cap 221, the second surface 232 which maintains the specific gap with respect to the cone portion 222, and the third surface 233 extended from the second surface 232 to the inner surface of the housing 21. The gap between the cap 221 and the first surface 231 may be configured such that the gap is increased from the center to the edge of the cap.

The first and second surfaces 231 and 232 may be arranged to correspond to the cap 221 and the cone portion 222 so that the gap distance between the first and second surfaces 231 and 232 and the cap 221 and the cone portion 222, respectively, is maintained to be substantially constant. Here, substantially constant means that there can be minor variations in the gap distance, where these minor variations do not impact the audio frequency response of the acoustic lens 23.

For example, the first surface 231 according to one exemplary embodiment is configured in a convex shape in the first direction (arrow ①), so that it can maintain the specific gap with respect to the cap 221. The second surface 232 according to one exemplary embodiment may have a sloping shape similar to that of the cone portion 222 so that the second surface 232 can maintain the specific gap with respect to the cone portion 222. A slightly convex or protruding transition shape in a reverse direction of the first direction (arrow ①) may be provided between the first and second surfaces 231 and 232, thus forming a crater shape facing the cap 221. The first surface 231 of the acoustic lens may be configured to have a curvature, or may be configured not to have the curvature. Although the first, second, and third surfaces 231, 232, and 233 according to one exemplary embodiment are referred to as divided regions, they may be connected in a continuous curved surface.

The acoustic lens 23 according to one exemplary embodiment may be placed inside the housing 21 to reflect the sound output from the speaker unit 22 in all 360-degrees of the second direction. For this, the acoustic lens 23 may be configured in a shape which is symmetrical with respect to a longitudinal axis of the housing 21. The speaker unit 22 may be placed inside the housing along a coaxial axis of the acoustic lens.

A movement path of the sound emitted from the speaker unit 22 according to one exemplary embodiment will be described below. The sound output in the first direction (arrow ①) from the speaker unit 22 may vibrate in the vibration portions 221 and 222 and thus an amplitude thereof is increased. The gap distance between the vibration portions 221 and 222 and the acoustic lens 23 may be adjusted so that the maximum amplitude is provided to the acoustic lens 23. After the amplitude increase, the sound may pass between the vibration portions 221 and 222 and the acoustic lens surfaces 231, 232, and 233 and proceed towards the sound hole 210 of the housing, and thereafter may exit the housing 21 in the second direction (arrow ②). The first direction (arrow ①) may substantially coincide with a longitudinal axis of the housing and the second direction (arrow ②) may be substantially perpendicular to the first direction, but without being limited thereto.

Referring to FIG. 2, the first surface 231 of the acoustic lens according to one embodiment may include an apogee point P1 most protruding towards the surface of the cap 221, and a perigee point P2 farthest from the surface of the cap 221. An offset o between points P1 and P2 may be in the range of 0.05 mm and 3.0 mm.

Figure 3:
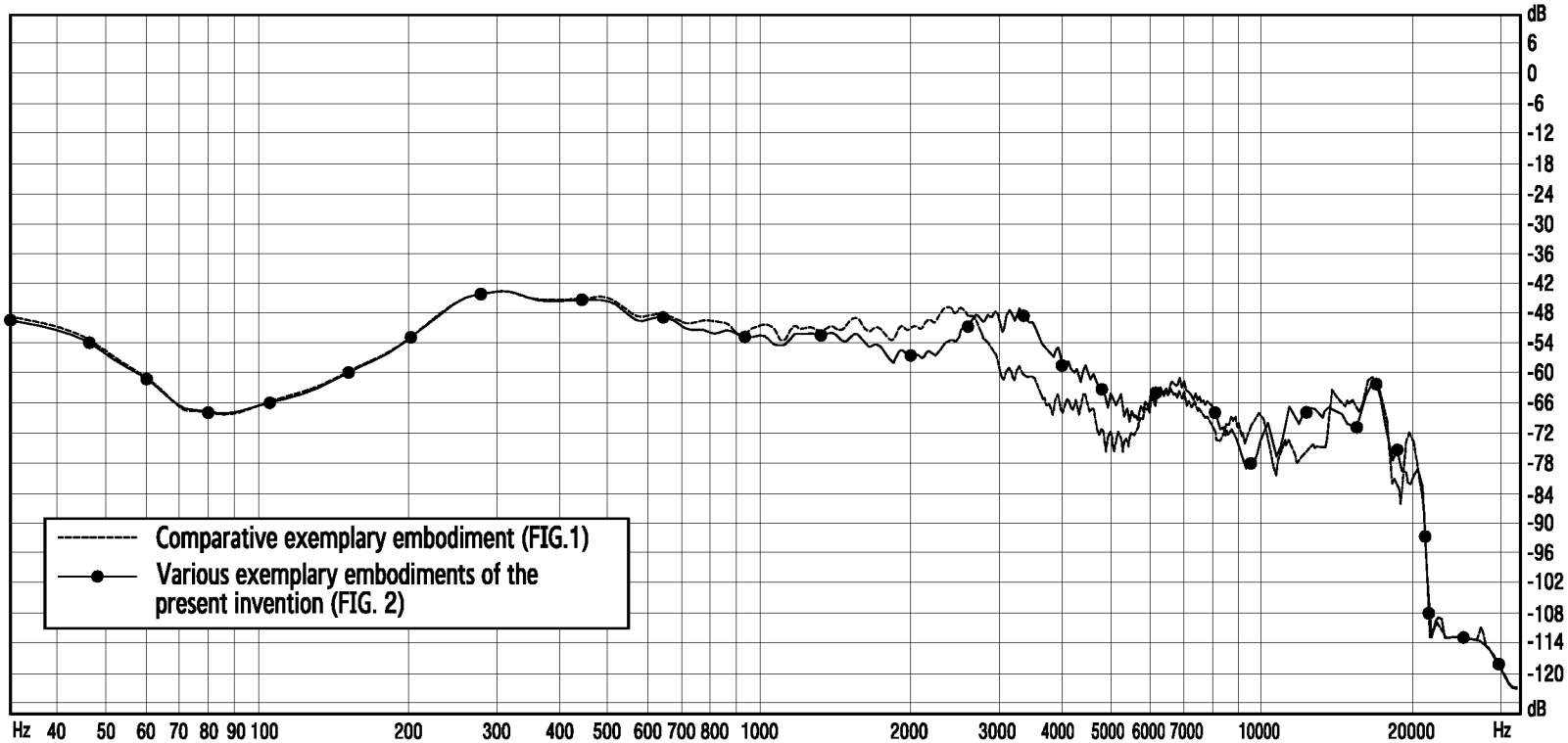
FIG. 3 is a graph illustrating sound test results for various audio bands for the speaker device according to the prior art as shown in FIG. 1 and the speaker device according to one exemplary embodiment of the present disclosure as shown in FIG. 2.
Figure 4:
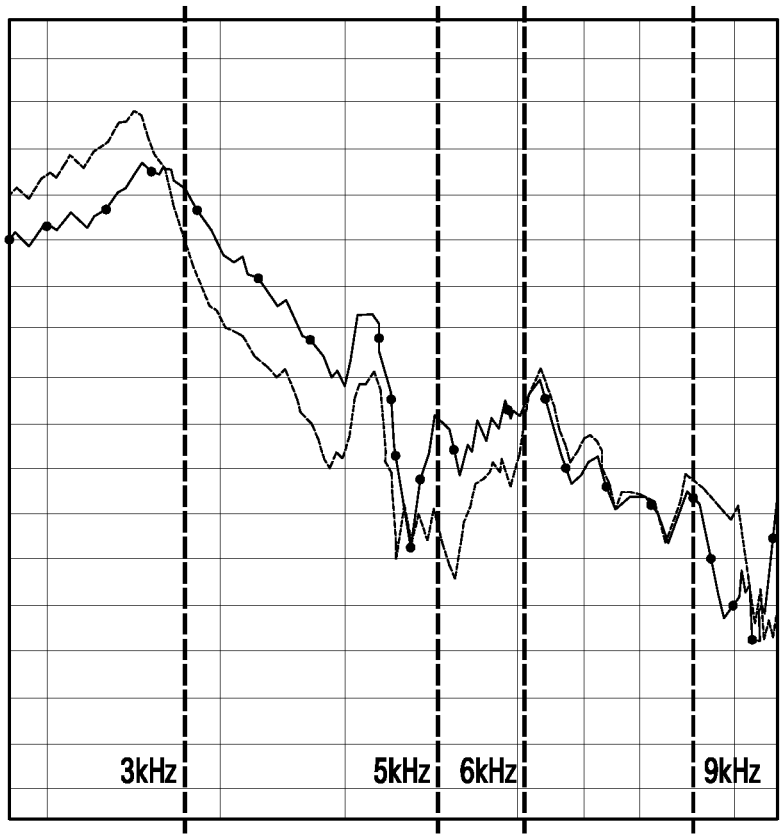
FIG. 4 is a graph illustrating a high frequency band of FIG. 3 by enlarging a part thereof according to one exemplary embodiment of the present disclosure.

FIG. 3 is a graph illustrating sound test result for various audio bands for the speaker device 10 according to the prior art as shown in FIG. 1 and the speaker device 20 according to one exemplary embodiment of the present disclosure of FIG. 2. FIG. 4 is a graph illustrating the high frequency band of FIG. 3 by enlarging a part thereof.

Referring to FIG. 3 and FIG. 4, a sound pressure performance measurement result is described as follows by comparing the speaker device 10 mounted with the acoustic lens 13 of FIG. 1 and the speaker device 20 mounted with the acoustic lens 23 of FIG. 2.

The speaker device 20 mounted with the acoustic lens 23 according to one exemplary embodiments of the present disclosure has improved sound performance at a high band in comparison with the speaker device 10 mounted with the acoustic lens 13 according to the prior art. For example, the speaker device 10 mounted with the acoustic lens 13 according to the prior art results in abrupt deterioration in a high-frequency band category, whereas the acoustic lens 23 according to one exemplary embodiment of the present disclosure results in relatively slow deterioration, thereby improving sound performance at a high-frequency band. Therefore, the speaker device 20 mounted with the acoustic lens 23 according to one exemplary embodiment of the present disclosure may have an extended reproduction band in comparison with the prior art.

Figure 5:
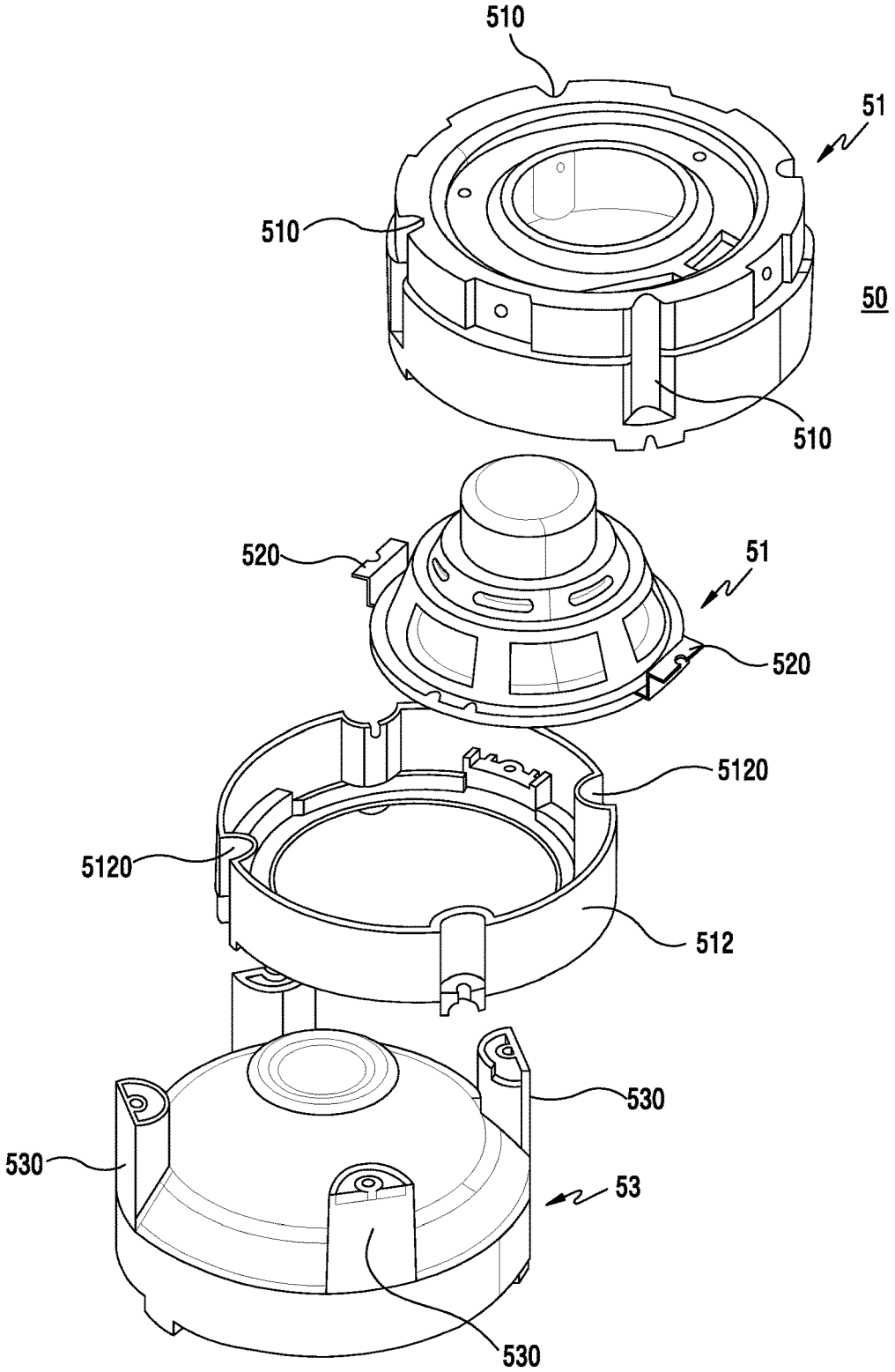
FIG. 5 is an exploded perspective view illustrating a speaker device according to one exemplary embodiment of the present disclosure.

FIG. 5 is an exploded perspective view illustrating a speaker device according to one exemplary embodiment of the present disclosure.

Referring to FIG. 5, a portable speaker device 50 according to one exemplary embodiments of the present disclosure may include a housing 51, an inner support construction 512 vertically coupled to the housing 51, and a speaker unit 52 and an acoustic lens 53 which are supported by the inner support construction 512. The speaker unit 52 may be coupled to one side of the inner support construction 512 and the acoustic lens 53 may be coupled to the other side, so that one surface of the speaker unit 52 and one surface of the acoustic lens 534 are disposed to face each other while maintaining a specific gap in the housing 51.

The acoustic lens 53 according to one exemplary embodiments may have coupling portions 530 at four places to be coupled with the inner support construction 512 and the housing 51. In addition, the inner support construction 512 may also have coupling portions 5120 at four places to be coupled with the acoustic lens 53, and the housing 51 may also have coupling portions 510 at four places. In addition, the speaker unit 52 may also have coupling portions 520 at four places to be supported by the inner support construction 512. The coupling construction is not necessarily limited to the four places.

The housing 51, the speaker unit 52, the inner support construction 512, and the acoustic lens 53 may be assembly as one entity by being combined in the vertical direction.

Figure 6:
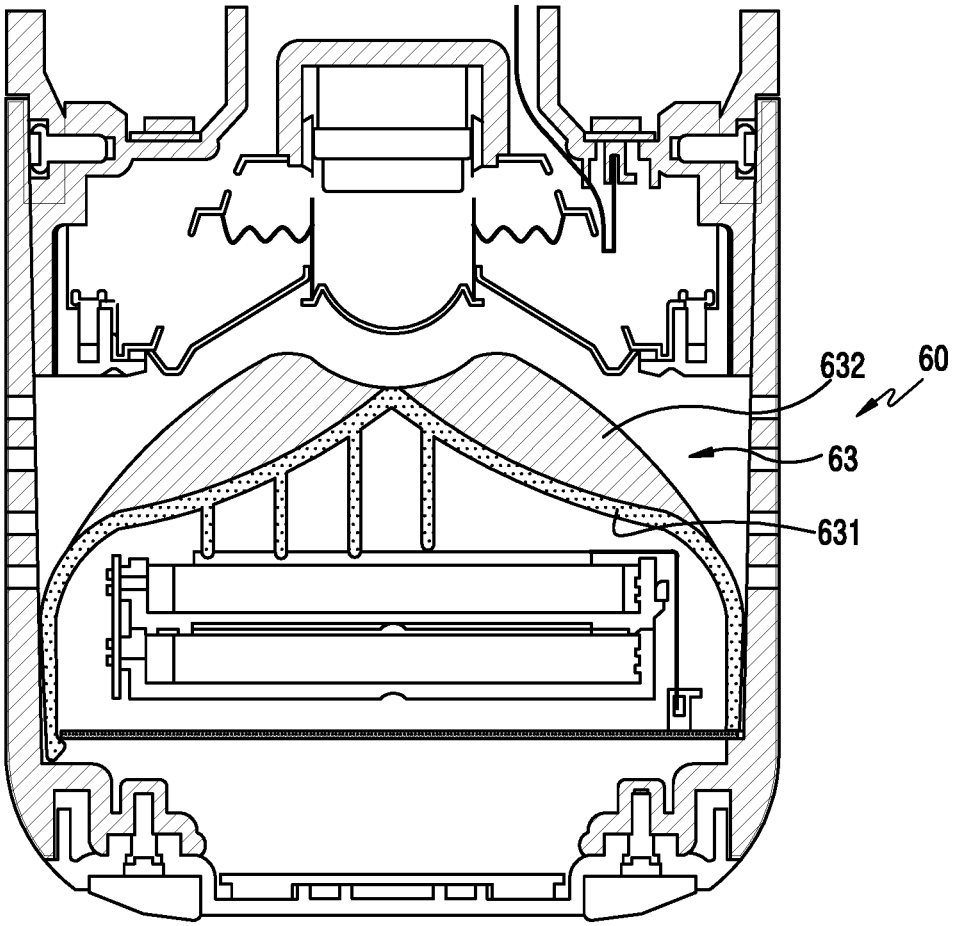
FIG. 6 is a cross-sectional view illustrating a structure of another speaker device according to another exemplary embodiment of the present disclosure.

FIG. 6 is a cross-sectional view illustrating a structure of another speaker device 60 according to another exemplary embodiment of the present disclosure.

Referring to FIG. 6, the speaker device 60 according to one exemplary embodiment may provide an acoustic lens identical or similar to FIG. 2 by additionally attaching a dummy lens 632 to an acoustic lens 631 identical to the acoustic lens 13 of FIG. 1. The speaker device 60 according to this exemplary embodiment may be configured in the same manner except for the speaker device of FIG. 2, and thus redundant descriptions will be omitted.

The acoustic lens 63 according to this exemplary embodiment may include the substantially cone-shaped acoustic lens 631 and the dummy lens 632 attached to one surface of the substantially cone-shaped acoustic lens 631. One surface of the dummy lens 632 may be a reflection surface for reflecting a sound, and the other surface may be a surface to be attached to the cone-shaped acoustic lens 631.

Figure 7:
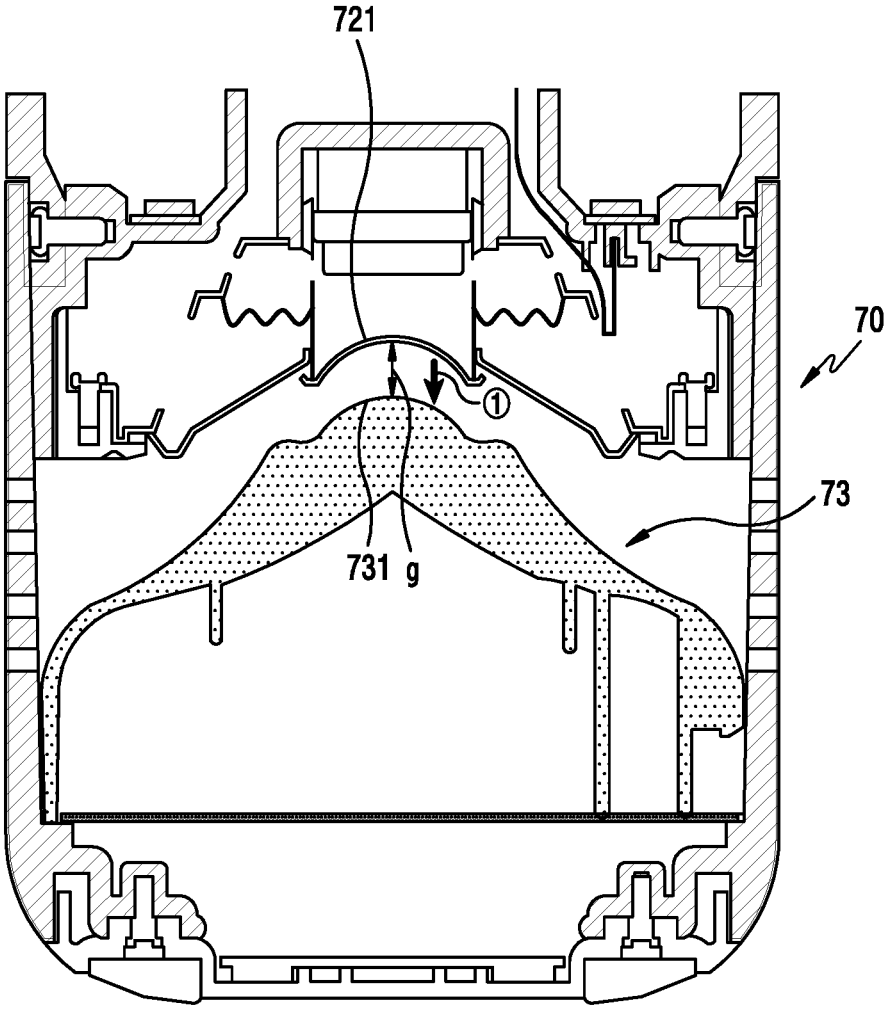
FIG. 7 is a cross-sectional view illustrating another speaker device according to yet another exemplary embodiment of the present disclosure.

FIG. 7 is a cross-sectional view illustrating another speaker device 70 according to yet another exemplary embodiment of the present disclosure.

Referring to FIG. 7, the speaker device 70 according to this exemplary embodiments may be configured in the same manner for the speaker device of FIG. 2 except for the cap and the acoustic lens, and thus the other detailed descriptions will be omitted.

The speaker device 70 according to this exemplary embodiment may include a cap 721 protruding or convex in a reverse direction of a first direction (arrow ①), and an acoustic lens 73 disposed to have a specific gap 'g' with respect to the cap 721. A first surface 731 of the acoustic lens 73 facing the cap 721 may have a surface also protruding or convex in the reverse direction of the first direction (arrow ①). The cap 721 may be configured to have or not to have a curvature, and the first surface 731 of the acoustic lens may be configured to have or not to have the curvature.

Figure 8:
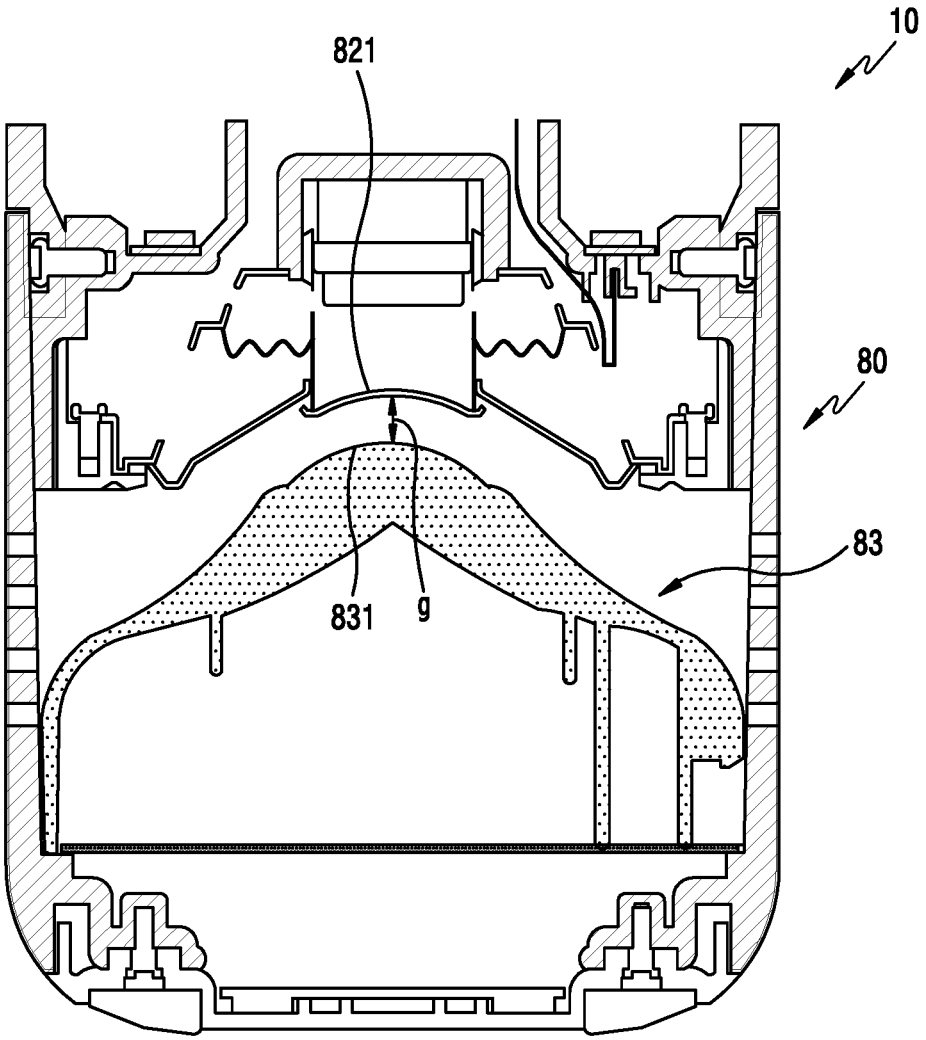
FIG. 8 is a cross-sectional view illustrating a structure of another speaker device according to yet another exemplary embodiment of the present disclosure.

FIG. 8 is a cross-sectional view illustrating a structure of another speaker device 80 according to yet another exemplary embodiment of the present disclosure.

Referring to FIG. 8, the speaker device 80 according to this exemplary embodiments may be configured in the same manner for the speaker device of FIG. 7 except for the cap 721 and the first surface 731 of the acoustic lens, and thus the other detailed descriptions will be omitted.

The speaker device 80 according to this exemplary embodiments may include a cap 821 protruding or convex in a reverse direction of a first direction (arrow ①), and an acoustic lens 83 disposed to have a specific gap 'g' with respect to the cap 821. As compared to the cap 721 of FIG. 7, the protrusion of the cap 821 is less. A first surface 831 of the acoustic lens facing the cap 821 may have a surface also slightly protruding or convex in the reverse direction of the first direction (arrow ①). Therefore, the cap 821 and the first surface 831 of the acoustic lens may be configured in a gentler curved shape in comparison with FIG. 7. The cap 821 may be configured to have or not to have a curvature, and the first surface 831 of the acoustic lens may be configured to have or not to have the curvature.

According to one exemplary embodiment of the present disclosure, a speaker device may include a housing, a speaker unit disposed substantially at a center of the housing and adapted to emit sound in a first direction, the speaker unit including a vibration portion includes a cap having a convex shape in the first direction and a cone portion extending outwardly from the cap, and an acoustic lens disposed in the housing having a surface facing the vibration portion, the acoustic lens is adapted to reflect the emitted sound in a second direction. A gap distance between the vibration portion of the speaker unit and the surface of the acoustic lens is substantially constant.

According to one exemplary embodiment of the present disclosure, the gap distance between the vibration portion and the surface of the acoustic lens is a distance at which the vibration portion provides a maximum amplitude of the sound to the acoustic lens.

According to one exemplary embodiment of the present disclosure, the surface of the acoustic lens may include a first surface having a shape so as to maintain the gap distance with respect to the cap and a second surface extending outwardly from the first surface and having a shape so as to maintain the gap distance with respect to the cone portion.

According to one exemplary embodiment of the present disclosure, the speaker device may further include a third surface extending outwardly from the second surface to an inner surface of the housing.

According to one exemplary embodiment of the present disclosure, the shape of the first surface is a convex shape in the first direction.

According to one exemplary embodiment of the present disclosure, a transition surface between the first and second surfaces may be further provided, the transition surface having a convex shape in a reverse direction of the first direction.

According to one exemplary embodiment of the present disclosure, the acoustic lens may reflect the sound in 360 degrees in the second direction.

According to one exemplary embodiment of the present disclosure, the first, second, and third surfaces of the acoustic lens may be symmetrical with respect to a longitudinal axis of the housing.

According to one exemplary embodiment of the present disclosure, the first, second, and third surfaces and the transition surface may form a continuously curved surface.

According to one exemplary embodiment of the present disclosure, the housing may have a plurality of sound holes so that the sound reflected by the acoustic lens is directed to an exterior of the housing.

According to one exemplary embodiment of the present disclosure, the first direction may substantially coincide with a longitudinal axis of the housing and the second direction may be substantially perpendicular to the first direction.

According to one exemplary embodiment of the present disclosure, the shape of the housing is cylindrical, polygonal, or spherical.

According to one exemplary embodiment of the present disclosure, the first, second, and transition surfaces may create a crater shape facing the vibration portion.

According to one exemplary embodiment of the present disclosure, the acoustic lens may include a substantially cone-shaped lens, and a dummy lens mounted on a surface of the cone-shaped acoustic lens facing the vibration portion, wherein a surface of the dummy lens facing the vibration portion is the surface of the acoustic lens facing the vibration portion.

According to one exemplary embodiment of the present disclosure, a portable speaker device may include a speaker unit having a vibration portion, and an acoustic lens having a surface disposed to face the vibration portion and adapted to reflect an emitted sound from the speaker unit. A gap distance between the vibration portion and the surface of the acoustic lens is a distance at which the vibration portion provides a maximum amplitude of the emitted sound to the acoustic lens, and the gap distance is substantially constant.

According to one exemplary embodiment of the present disclosure, an electronic device may include a housing, a speaker device disposed inside the housing, and a sound generation circuit electrically connected to the speaker device. The speaker device may include a sound generation plate movable in a first direction when sound is generated by the sound generation circuit, and a sound reflection construction facing the sound generation plate to form a space between the sound generation plate and the sound reflection construction. The space is in fluidic communication with an exterior of the housing via a plurality of sound holes formed in a outer wall of the housing, the sound generation plate includes a first surface disposed substantially at a center of the sound generation plate, the first surface having a convex shape when viewed from inside the space, and the sound reflection construction includes a second surface substantially aligned with the first surface along an axis of the housing, the second surface having a concave shape when viewed from inside the space.

According to one exemplary embodiment of the present disclosure, the first surface of the sound generation plate may be in a shape of a first substantially circular arc having a first diameter, and the second surface of the sound reflection construction may be in a shape of a second substantially circular arc having a second diameter.

According to one exemplary embodiment of the present disclosure, the first diameter may be less than the second diameter.

According to one exemplary embodiment of the present disclosure, a distance between the first surface and the second surface may be substantially constant.

According to one exemplary embodiment of the present disclosure, a distance between the first surface and the second surface may be increased from a center of the first surface to an edge of the first surface.

According to one exemplary embodiment of the present disclosure, a distance between the first surface and the second surface may be in a range of 0.05 mm and 3.0 mm at a center of the first surface.

According to one exemplary embodiment of the present disclosure, a shape of the housing may be cylindrical, polygonal, or spherical, and the housing may have a longitudinal axis substantially coinciding with the first direction.

According to one exemplary embodiment of the present disclosure, the second surface may include an apogee point closest to the first surface and a perigee point farthest away from the first surface. A distance between the apogee point and the perigee point may be in a range of 0.05 mm and 3.0 mm.

The term "module" or "unit" as used herein may be used interchangeably with the terms "component," "circuit," or etc. The "module" may be the minimum unit of an integrally constructed component or a part thereof. The "module" may be also the minimum unit performing one or more functions or a part thereof. The "module" may be implemented mechanically or electronically.

The module according to the present disclosure may include at least one or more of the aforementioned constituent elements, or omit some of the aforementioned constituent elements, or further include additional other constituent elements.

While the present disclosure has been shown and described with reference to certain embodiments thereof, it will be apparent to those skilled in the art that the camera lens module according to the present disclosure is not limited to these embodiments, and various changes in form and details may be made therein without departing from the spirit and scope of the present disclosure as defined by the appended claims.

What is claimed is:

1. A speaker device comprising:

a housing;

a speaker unit disposed substantially at a center of the housing and adapted to emit sound in a first direction, the speaker unit including a vibration portion comprising a cap having a convex shape in the first direction and a cone portion extending outwardly from the cap; and an acoustic lens disposed in the housing having a surface facing the vibration portion, the acoustic lens adapted to reflect the emitted sound in a second direction, wherein a gap distance between the vibration portion of the speaker unit and the surface of the acoustic lens is substantially constant, wherein the gap distance between the vibration portion and the surface of the acoustic lens is a distance at which the vibration portion provides a maximum amplitude of the sound to the acoustic lens, wherein the surface of the acoustic lens comprises:

a first surface having a shape so as to maintain the gap distance with respect to the cap; and a second surface extending outwardly from the first surface and having a shape so as to maintain the gap distance with respect to the cone portion, wherein the second surface includes an apogee point closest to the first surface and a perigee point farthest away from the first surface, and wherein a distance between the apogee point and the perigee point is in a range of 0.05 mm and 3.0 mm.

2. The device of claim 1, further comprising a third surface extending outwardly from the second surface to an inner surface of the housing.

3. The device of claim 2, wherein the acoustic lens reflects the sound in 360 degrees in the second direction.

4. The device of claim 2, wherein the first, second, and third surfaces of the acoustic lens are symmetrical with respect to a longitudinal axis of the housing, and wherein the first, second, and third surfaces and a transition surface form a continuously curved surface.

5. The device of claim 1, wherein the shape of the first surface is a convex shape in the first direction.

6. The device of claim 1, further comprising a transition surface between the first and second surfaces, the transition surface having a convex shape in a reverse direction of the first direction.

7. The device of claim 6, wherein the first, second, and transition surfaces create a crater shape facing the vibration portion.

8. The device of claim 1, wherein the housing includes a plurality of sound holes so that the sound reflected by the acoustic lens is directed to an exterior of the housing.

9. The device of claim 1, wherein the first direction substantially coincides with a longitudinal axis of the housing and the second direction is substantially perpendicular to the first direction.

10. The device of claim 1, wherein the acoustic lens comprises:

a substantially cone-shaped acoustic lens; and a dummy lens mounted on a surface of the cone-shaped acoustic lens facing the vibration portion, wherein a surface of the dummy lens facing the vibration portion is the surface of the acoustic lens facing the vibration portion.

11. A portable speaker device comprising:

a speaker unit having a vibration portion; and an acoustic lens having a surface disposed to face the vibration portion and adapted to reflect an emitted sound from the speaker unit, wherein a gap distance between the vibration portion and the surface of the acoustic lens is a distance at which the vibration portion provides a maximum amplitude of the emitted sound to the acoustic lens, and the gap distance is substantially constant, wherein the surface of the acoustic lens comprises:

a first surface having a shape so as to maintain the gap distance with respect to a cap; and a second surface extending outwardly from the first surface and having a shape so as to maintain the gap distance with respect to a cone portion, wherein the second surface includes an apogee point closest to the first surface and a perigee point farthest away from the first surface, and wherein a distance between the apogee point and the perigee point is in a range of 0.05 mm and 3.0 mm.

12. An electronic device comprising:

a housing;

a speaker device disposed inside the housing; and a sound generation circuit electrically connected to the speaker device, wherein the speaker device comprises:

a sound generation plate movable in a first direction when sound is generated by the sound generation circuit; and a sound reflection construction facing the sound generation plate to form a space between the sound generation plate and the sound reflection construction, wherein the space is in fluidic communication with an exterior of the housing via a plurality of sound holes formed in an outer wall of the housing, wherein the sound generation plate comprises a first surface disposed substantially at a center of the sound generation plate, the first surface having a convex shape when viewed from inside the space, wherein the sound reflection construction comprises a second surface substantially aligned with the first surface along an axis of the housing, the second surface having a concave shape when viewed from inside the space, and wherein the second surface includes an apogee point closest to the first surface and a perigee point farthest away from the first surface, and wherein a distance between the apogee point and the perigee point is in a range of 0.05 mm and 3.0 mm.

13. The device of claim 12, wherein the first surface of the sound generation plate is in a shape of a first substantially circular arc having a first diameter, and the second surface of the sound reflection construction is in a shape of a second substantially circular arc having a second diameter, and wherein the first diameter is less than the second diameter.

14. The device of claim 12, wherein a distance between the first surface and the second surface is substantially constant.

15. The device of claim 12, wherein a distance between the first surface and the second surface is increased from a center of the first surface to an edge of the first surface.

16. The device of claim 12, wherein a distance between the first surface and the second surface is in a range of 0.05 mm and 3.0 mm at a center of the first surface.

17. The device of claim 12, wherein a shape of the housing is cylindrical, polygonal, or spherical, and the housing includes a longitudinal axis substantially coinciding with the first direction.

* * * * *